US007468698B2

(12) United States Patent
Fujii et al.

(10) Patent No.: US 7,468,698 B2
(45) Date of Patent: Dec. 23, 2008

(54) PATCH ANTENNA, ARRAY ANTENNA, AND MOUNTING BOARD HAVING THE SAME

(75) Inventors: Tomoharu Fujii, Nagano (JP); Yasutake Hirachi, Kamakura (JP); Hiroshi Nakano, Yamanashi (JP)

(73) Assignees: Shinko Electric Industries Co., Ltd., Nagano (JP); Eudyna Devices Inc., Yamanashi (JP)

( * ) Notice: Subject to any disclaimer, the term of this patent is extended or adjusted under 35 U.S.C. 154(b) by 189 days.

(21) Appl. No.: 11/264,592

(22) Filed: Nov. 1, 2005

(65) Prior Publication Data

US 2006/0097926 A1 May 11, 2006

(30) Foreign Application Priority Data

Nov. 5, 2004 (JP) ..... 2004-322610

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS 4,138,684 A * 2/1979 Kerr ..... 343/846
4,464,663 A * 8/1984 Lalezari et al. ..... 343/700 MS
5,270,722 A * 12/1993 Delestre ..... 343/700 MS

FOREIGN PATENT DOCUMENTS

JP 621715 1/1994

* cited by examiner

*Primary Examiner*—Michael C Wimer
(74) *Attorney, Agent, or Firm*—Ladas & Parry LLP

(57) ABSTRACT

A patch antenna is disclosed that includes a dielectric substrate, a substantially rectangular radiation element formed of a conductive material on the dielectric substrate; and a feeder line connected to a feeding point for feeding to the radiation element. The feeding point has an impedance matching the impedance of the feeder line.

10 Claims, 11 Drawing Sheets

| | PATCH1 | PATCH2 | PATCH3 | PATCH4 | PATCH5 | PATCH6 | PATCH7 | PATCH8 | PATCH9 |
|---|---|---|---|---|---|---|---|---|---|
| A(mm) | 1.6 | 1.8 | 2.0 | 2.2 | 2.4 | 2.8 | 3.0 | 3.6 | 3.8 |
| B(mm) | 1.234 | 1.228 | 1.224 | 1.220 | 1.216 | 1.211 | 1.209 | 1.2 | 1.18 |
| C(mm) | 0.761 | 0.755 | 0.751 | 0.746 | 0.740 | 0.735 | 0.732 | | |
| D(mm) | 0.052 | 0.070 | 0.090 | 0.110 | 0.130 | 0.173 | 0.19 | | |
| ANTENNA INPUT END Z (Ω) | 232 | 183 | 149 | 124 | 105 | 78 | 69 | 51 | 42 |
| ANTENNA GAIN (dBi) | 3.40 | 3.88 | 4.03 | 4.53 | 4.43 | 4.72 | 5.13 | 5.97 | 4.98 |

PATCH ANTENNA, ARRAY ANTENNA, AND MOUNTING BOARD HAVING THE SAME

BACKGROUND OF THE INVENTION

1. Field of the Invention

The present invention relates generally to patch antennas, array antennas, and mounting boards having the same, and more particularly to a patch antenna and an array antenna used for GPS (Global Positioning System) and ETC (Electronic Toll Collection System), and a mounting board having the same.

2. Description of the Related Art

In general, a patch antenna, which is a planar antenna, has a rectangular or circular shape. FIG. 1 is a perspective view of a patch antenna 110 of an MSL feeding type. As shown in FIG. 1, in the case of feeding to an antenna pattern by microstrip line (MSL) feeding, a matching circuit 106 that performs impedance matching is provided between an MSL 102 and an antenna part 101 since the MSL 102 has an impedance ($Z_0$=50 Ω) different from that of the input end of the antenna part 101. The matching circuit 106 is a circuit of a specific frequency (λ/4, λ=wavelength) whose impedance is the square root of the product of the impedance of the input end of the antenna part 101 and the impedance of the MSL 102 as shown in the following equation:

$$Z=\sqrt{Z_0 \times Z_1},$$

where Z is the impedance of the λ/4 matching circuit 106, $Z_0$ is the impedance of the MSL 102, and $Z_1$ is the impedance of the input end of the antenna part 101.

With respect to impedance matching, Japanese Laid-Open Patent Application No. 6-021715 discloses a planar antenna having a triplate structure. In this planar antenna, a circular microstrip antenna (MSA) element having a hole in its center is employed as a radiation element, so that the input impedance of the radiation element is made variable by changing its ring ratio. Further, the shape and size of the end part of a feeder and the distance between the end part of the feeder and the center of the radiation element are made variable. As a result, impedance matching is achieved with a simple structure without reducing the antenna gain (radiation efficiency).

The above-described technique, however, has the following disadvantages.

The matching circuit is a resonance circuit, and has frequency components. Therefore, the matching circuit may affect the frequency characteristics of the antenna. For example, since the matching circuit allows matching only at a specific frequency, the frequency band of the antenna is narrowed.

Further, since an extension circuit up to the antenna input part is increased in length, the antenna is more likely to be affected by the electric characteristics of a dielectric, such as dielectric loss.

The antenna area may be increased as a method of increasing gain by changing the antenna pattern. However, considering interconnection line density, this method is not effective as means of increasing the gain of a rectangular antenna.

SUMMARY OF THE INVENTION

Accordingly, it is a general object of the present invention to provide a patch antenna and an array antenna in which the above-described disadvantages are eliminated.

A more specific object of the present invention is to provide a patch antenna and an array antenna that can improve antenna characteristics, and a mounting board having such an array antenna.

The above objects of the present invention are achieved by a patch antenna including a dielectric substrate, a substantially rectangular radiation element formed of a conductive material on the dielectric substrate, and a feeder line connected to a feeding point for feeding to the radiation element, wherein the feeding point has an impedance matching an impedance of the feeder line.

According to one embodiment of the present invention, it is possible to reduce the length of a feeding circuit up to an antenna part, that is, a radiation element, so that it is possible to reduce power loss.

The above objects of the present invention are also achieved by a patch antenna including a dielectric substrate and a substantially rectangular radiation element formed of a conductive material on the dielectric substrate, wherein the radiation element includes a concave part on a first side thereof opposite to a second side thereof on which a feeding point is formed.

According to one embodiment of the present invention, it is possible to improve antenna gain with the above-described configuration.

The above objects of the present invention are also achieved by an array antenna including a plurality of patch antennas combined and arranged, wherein each of the patch antennas is a patch antenna according to the present invention.

According to one embodiment of the present invention, it is possible to arrange radiation elements with a reduced pitch with the above-described configuration.

The above objects of the present invention are also achieved by a mounting board including an array antenna formed by combining and arranging a plurality of patch antennas, wherein each of the patch antennas is a patch antenna according to the present invention.

According to embodiments of the present invention, it is possible to achieve a patch antenna and an array antenna that can improve antenna characteristics, and a mounting board having such an array antenna.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
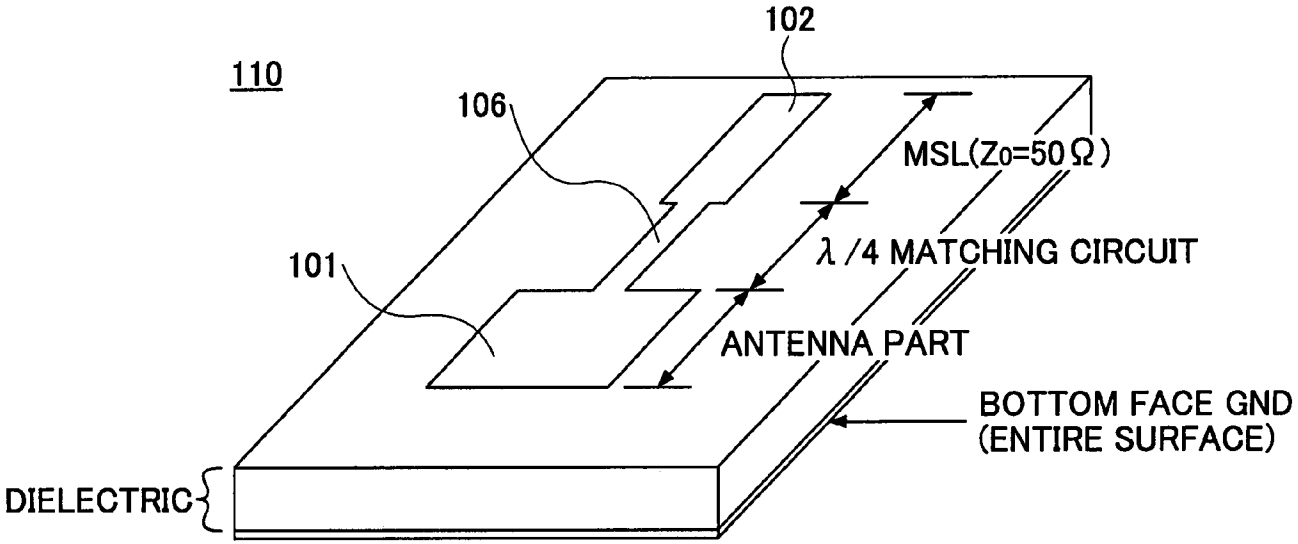
FIG. 1 is a perspective view of a patch antenna of an MSL feeding type.

A description is given below, with reference to the accompanying drawings, of embodiments of the present invention.

In the drawings for illustrating the embodiments, the same elements are referred to by the same numerals, and a description thereof is not given repetitiously.

Figure 2:
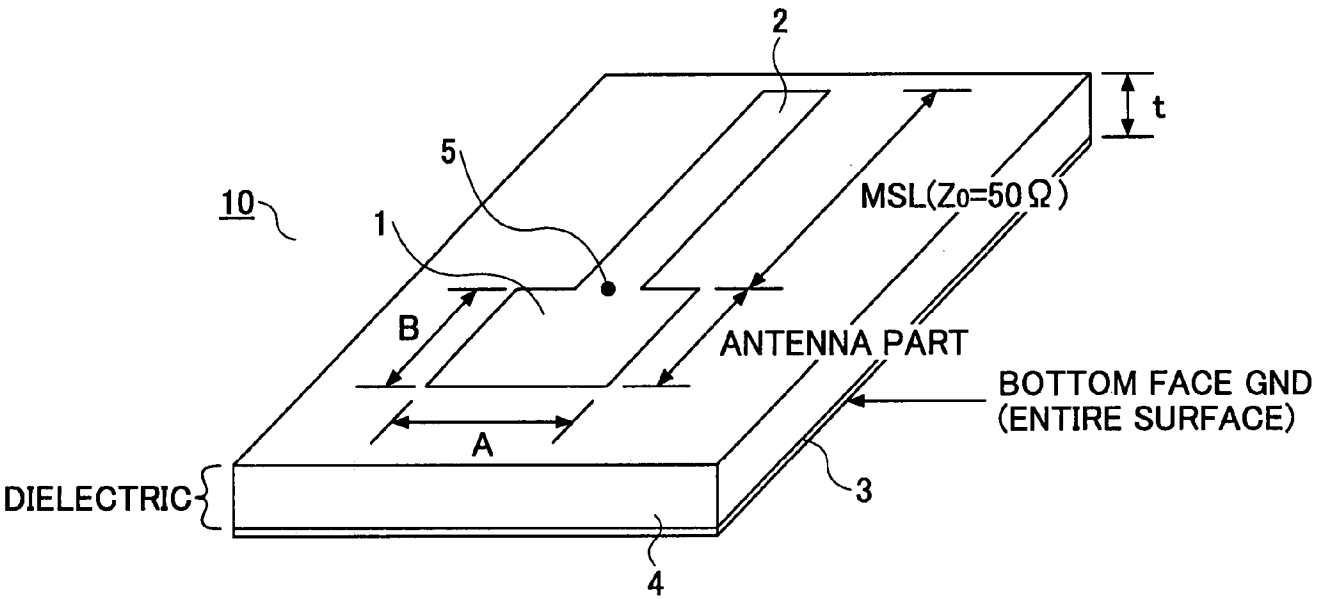
FIG. 2 is a perspective view of a patch antenna according to a first embodiment of the present invention.
Figure 3:
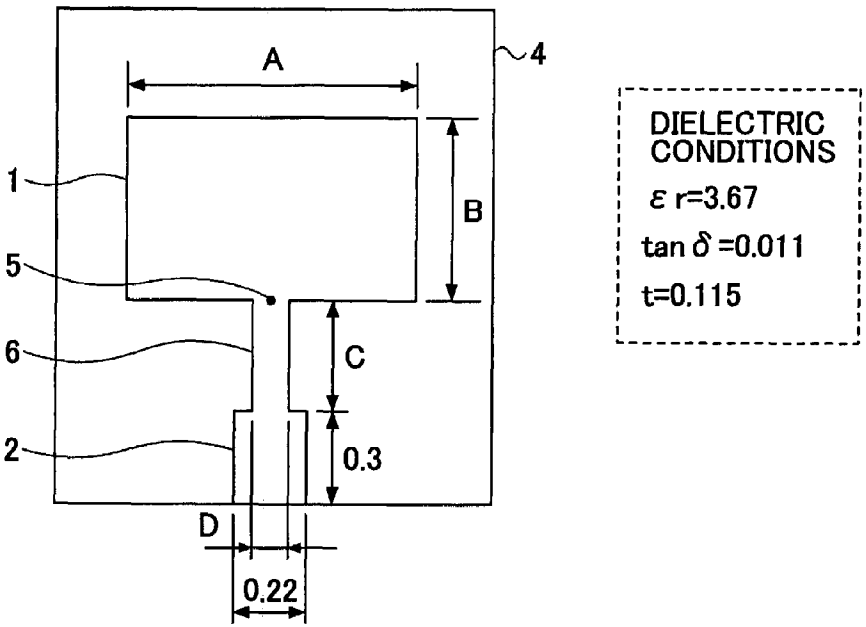
FIG. 3 shows the relationship between antenna dimensions and antenna gain in the patch antenna according to the first embodiment of the present invention.

A description is given, with reference to FIGS. 2 and 3, of a first embodiment of the present invention.

FIG. 2 is a perspective view of a patch antenna 10 according to the first embodiment. Referring to FIG. 2, the patch antenna 10 includes a dielectric substrate 4 of a thickness t and a dielectric constant $\epsilon_r$ and a substantially rectangular radiation element (patch) 1 of a conductive material formed on a first surface of the dielectric substrate 4. A ground (GND) layer 3 is formed on a second or bottom surface of the dielectric substrate 4 on the opposite side from the first surface. Two adjacent sides of the radiation element 1 are A and B in length, where A is greater than B (A>B). A feeding point 5 of the radiation element 1 is the end part of the radiation element 1 (antenna part) and is a predetermined part of an A-length side of the radiation element 1. A feeder line 2, for example, a microstrip line (MSL), is directly connected to the feeding point 5, so that feeding is performed.

In the patch antenna 10 according to this embodiment, the transmission line impedance of the feeder line 2 and the input impedance of the feeding point 5 are equalized to match each other.

Specifically, the input impedance of the input end (feeding point 5) of the radiation element 1 is determined by the length A of the side on which the feeding point 5 is formed. The input impedance of the feeding point 5 can be varied by varying this length. Using this property, the input impedance of the feeding point 5 is adjusted to be equal to and match the transmission line impedance of the feeder line 2.

A description is given below of the case of configuring patch antennas applicable to a 60-GHz frequency band.

As shown in FIG. 3, the rectangular radiation element 1, a matching circuit 6, and the feeder line 2 were formed on the dielectric substrate 4 whose thickness t is 0.115 mm, dielectric constant $\epsilon_r$ is 3.67, and dielectric loss tangent tan δ is 0.011, and letting the length of the side on which the feeding point 5 is formed, the length of a side perpendicular thereto, the length of the matching circuit 6, and the width of the matching circuit 6 be A, B, C, and D, respectively, values of the input impedance of the antenna input end (feeding point 5) were obtained by varying A.

Referring to the table of FIG. 3, the results show that as A increases, the input impedance of the antenna input end decreases. For example, when A is 1.6 mm (Patch 1), the input impedance of the antenna input end is 232Ω. Meanwhile, when A is 3.8 mm (Patch 9), the input impedance of the antenna input end is 42 Ω. Thus, by varying the length A of the side on which the feeding point 5 is formed, it is possible to vary the impedance of the feeding point 5.

Using this property, it is possible to set the input impedance of the input end of the antenna part, that is, the feeding point 5, to approximately 50Ω by setting A to approximately 3.6 mm (Patch 8) when the transmission line impedance of the feeder line 2 is $Z_0$ (=50Ω). Accordingly, the impedance of the transmission line impedance of the feeder line 2 and the input impedance of the feeding point 5 of the radiation element 1 can be equalized to match each other.

By this configuration, it is possible to connect the feeder line 2 and the radiation element 1 directly to each other. As a result, it is possible to delete the matching circuit 6 and thus to reduce the effect of the matching circuit 6 over the frequency characteristics of the antenna. Further, since a feeding circuit up to the radiation element 1 can be shortened, it is possible to reduce power loss. Further, it is possible to arrange patch antennas at a narrow pitch in the case of forming an array antenna.

Next, a description is given, with reference to FIGS. 4 through 7, of a second embodiment of the present invention.

Figure 4:
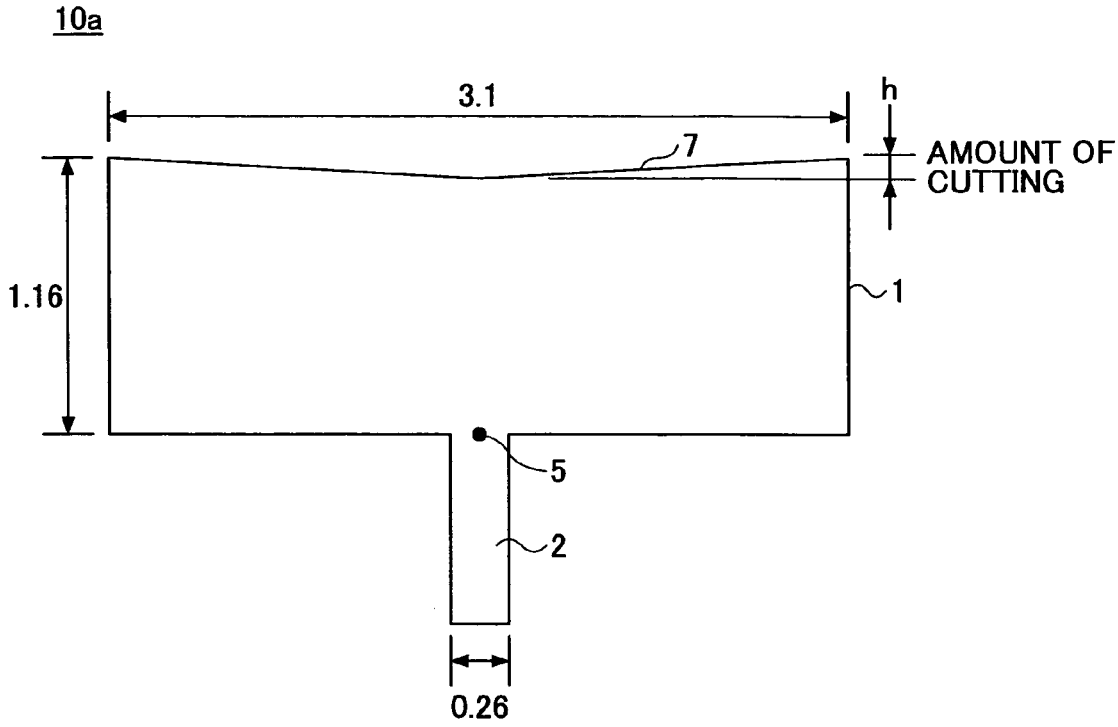
FIG. 4 is a schematic diagram showing a patch antenna according to a second embodiment of the present invention.

FIG. 4 is a schematic diagram showing a patch antenna 10*a* according to the second embodiment. FIG. 4 shows the radiation element 1 and the feeder line 2 of the patch antenna 10*a*. Referring to FIG. 4, the patch antenna 10*a* is configured by forming a cut part (concave part) 7 on the side of the radiation element (patch) 1 opposite to the side on which the feeding point 5 is formed in the patch antenna 10 (FIG. 2) of the first embodiment. Specifically, a substantially triangular cut whose base is the side opposite to the feeding point 5 is formed in the radiation element 1. That is, in the radiation element 1 of the patch antenna 10*a*, the side (edge) opposite to the feeding point 5 is defined by two line segments so as to be concave toward the feeding point 5.

For instance, in the radiation element 1 whose adjacent two sides are 3.1 mm and 1.16 mm in length, a cut shaped like a triangle (for example, an isosceles triangle), whose height h with the base of 3.1 mm is substantially greater than 0% and less than or equal to 20% ($0<h\leqq 0.2$) of the length of 1.16 mm of a side adjacent to the side on which the feeding point 5 is formed, may be formed.

A description is given below of the case of configuring patch antennas applicable to a 60-GHz frequency band.

Figure 5:
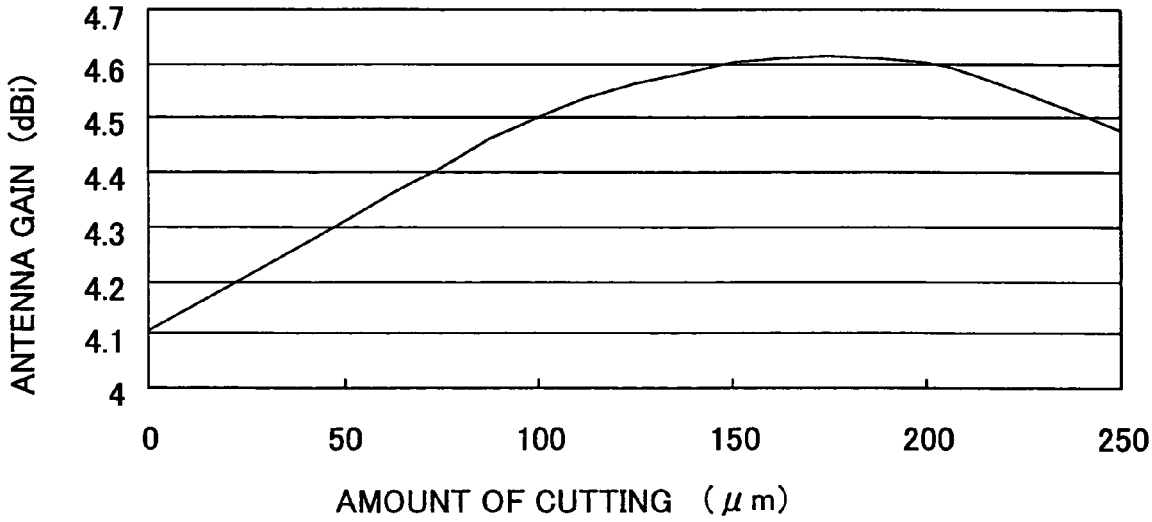
FIG. 5 is a graph for illustrating the relationship between the amount of cutting and antenna gain in the patch antenna according to the second embodiment of the present invention.

FIG. 5 is a graph showing the variation of the antenna gain in the case of varying the amount of cutting, which is the height h of the cut part 7. The amount of cutting was varied from 0 μm to 250 μm. These values of the amount of cutting correspond to 0% to approximately 22% of the length of a side adjacent to the side on which the feeding point 5 is formed.

Referring to FIG. 5, as the amount of cutting increases, the antenna gain increases. The antenna gain is maximized when the amount of cutting is approximately 175 μm. This amount of cutting of 175 μm corresponds to approximately 15% of the length of a side adjacent to the side on which the feeding point 5 is formed. In this case, compared with a gain of 4.1 dBi of a patch antenna without a cut, the gain of the patch antenna with the cut of 175 μm in amount is 4.6 dBi, thus improving the antenna gain by approximately 0.5 dB.

As the amount of cutting increases from 175 μm to 250 μm, the antenna gain decreases. However, even when the amount of cutting is 250 μm, the antenna gain is approximately 4.48 dBi. Thus, it is still possible to improve the antenna gain compared with the case of providing no cut. Therefore, by providing the antenna (antenna part) with a substantially triangular cut part whose base is the side opposite to the side on which the feeding point 5 is formed and whose height is substantially greater than 0% and less than or equal to 20% of the length of a side adjacent to the side on which the feeding point 5 is formed, it is possible to improve the antenna gain compared with the case of providing no cut.

Practically, the length of a side adjacent to the side on which the feeding point 5 is formed may need adjustment in order to prevent the shift of the center frequency of the patch antenna 10 due to provision of the cut part 7. Specifically, the length may be reduced by 0% to 20% based on the height h of the cut part 7.

Figure 6:
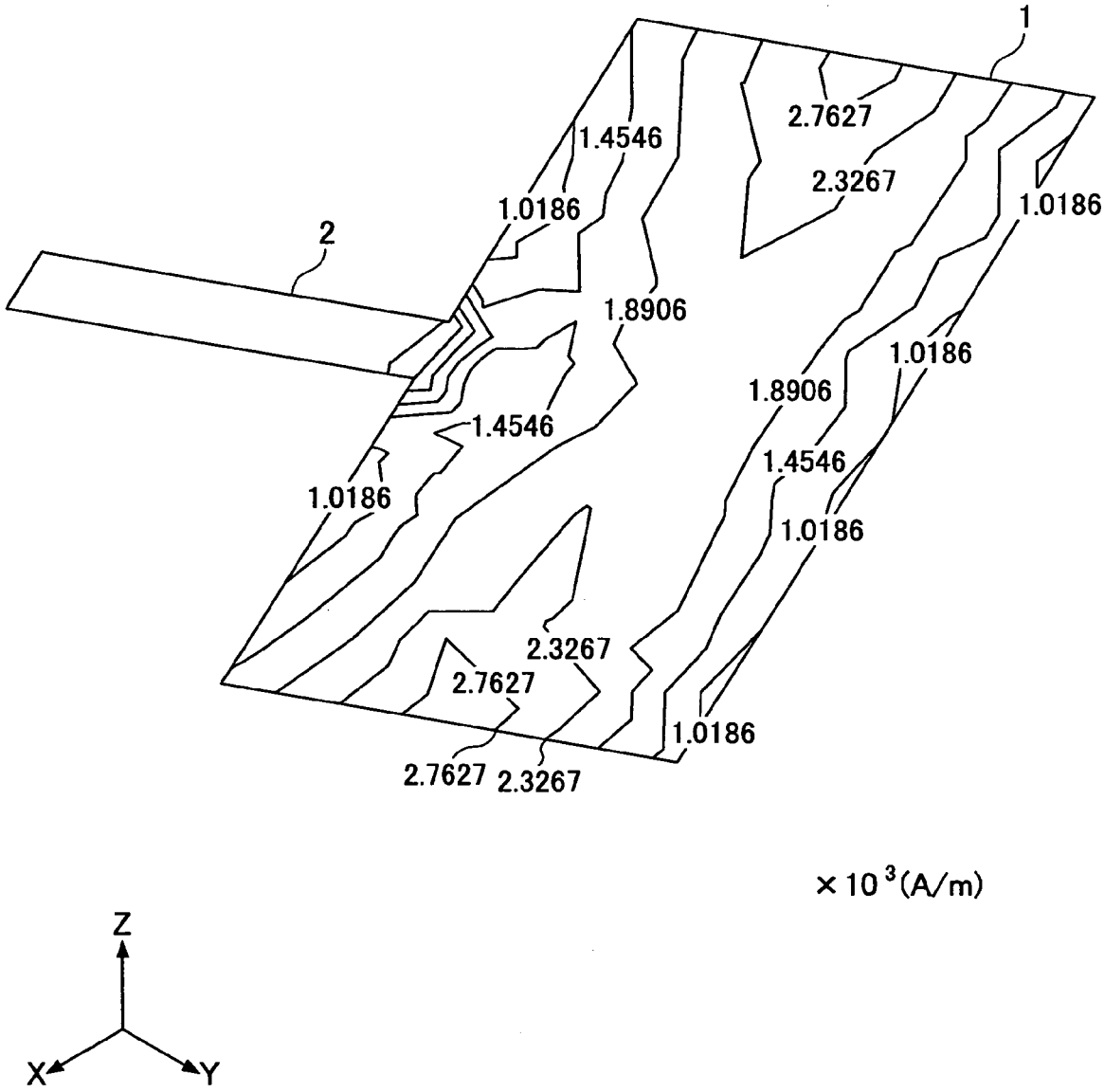
FIG. 6 is a diagram showing a current distribution of the patch antenna of the first embodiment of the present invention.
Figure 7:
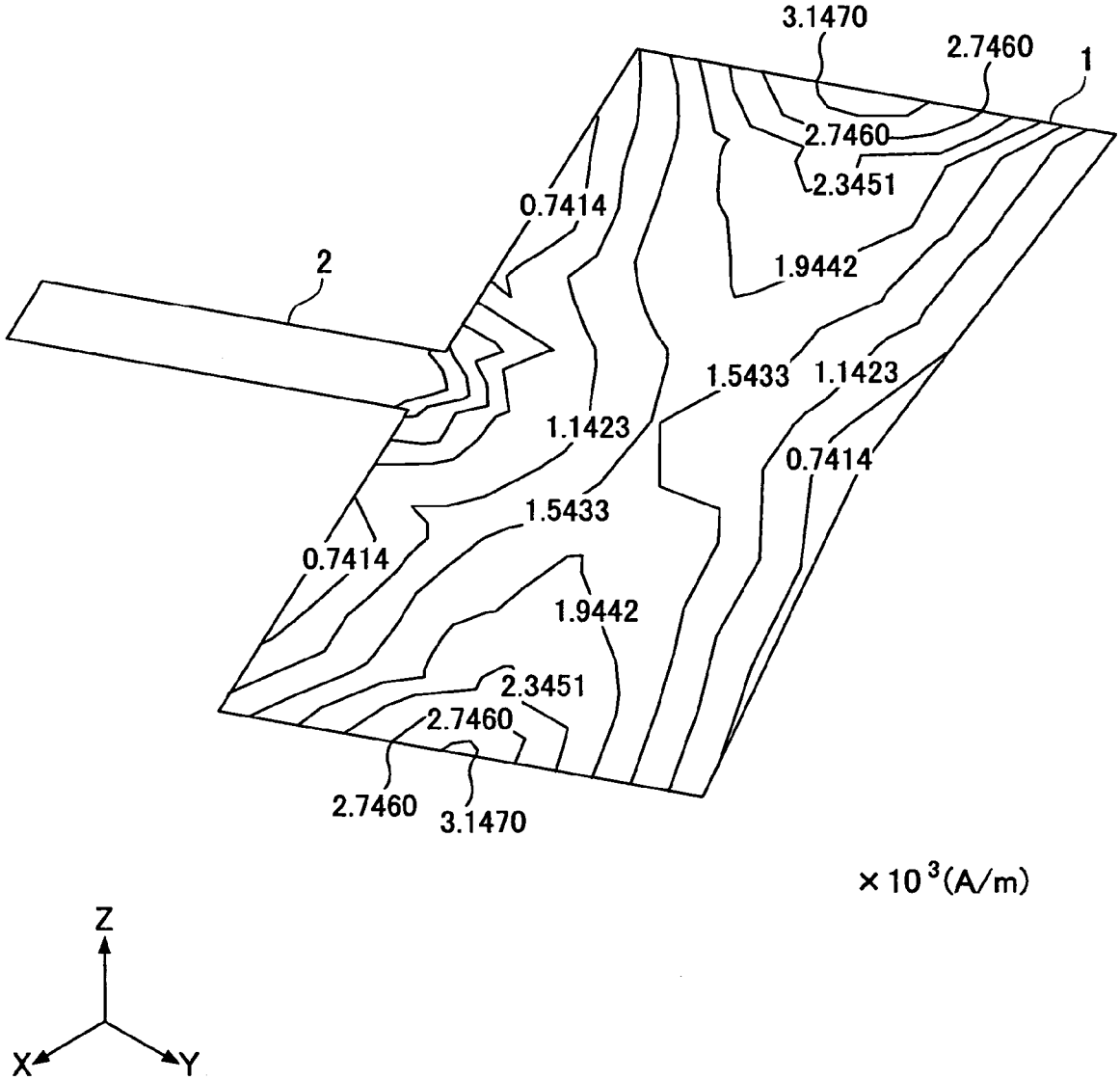
FIG. 7 is a diagram showing a current distribution of the patch antenna of the second embodiment of the present invention.

Next, a description is given, with reference to FIGS. 6 and 7, of current distribution on the radiation element 1 in accordance with the presence or absence of a cut part. FIG. 6 is a diagram showing a current distribution of the patch antenna 10 of the first embodiment. FIG. 7 is a diagram showing a current distribution of the patch antenna 10*a* of the second embodiment. In FIGS. 6 and 7, a description of current distribution on the feeder line 2 is omitted.

FIG. 6 shows that in the case of providing no cut part, current values are high in the center area of each of the two sides adjacent to the side on which the feeding point 5 is formed. These parts (areas) are a transmission source from which the radio waves of the patch antenna are radiated.

FIG. 7 shows that in the case of providing a cut part, not only are current values high in the center area of each of the two sides adjacent to the side on which the feeding point 5 is formed, but also the current values are higher than in the case of providing no cut part. Accordingly, provision of a cut part makes it possible to concentrate current in the transmission source from which the radio waves of the patch antenna are radiated. This leads to improvement of the antenna gain.

Figure 8A:
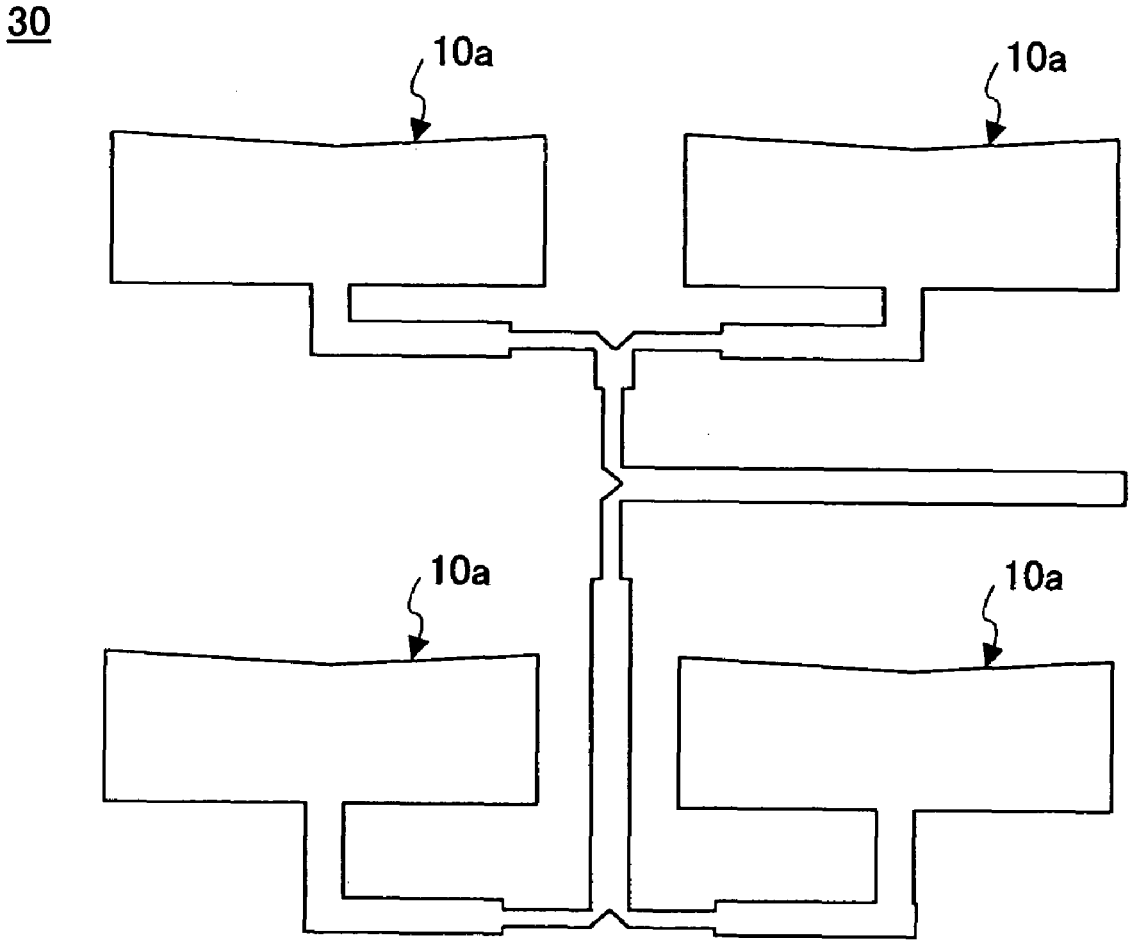
FIG. 8A is a diagram showing an array patch antenna configured by arranging four patch antennas.
Figure 8B:
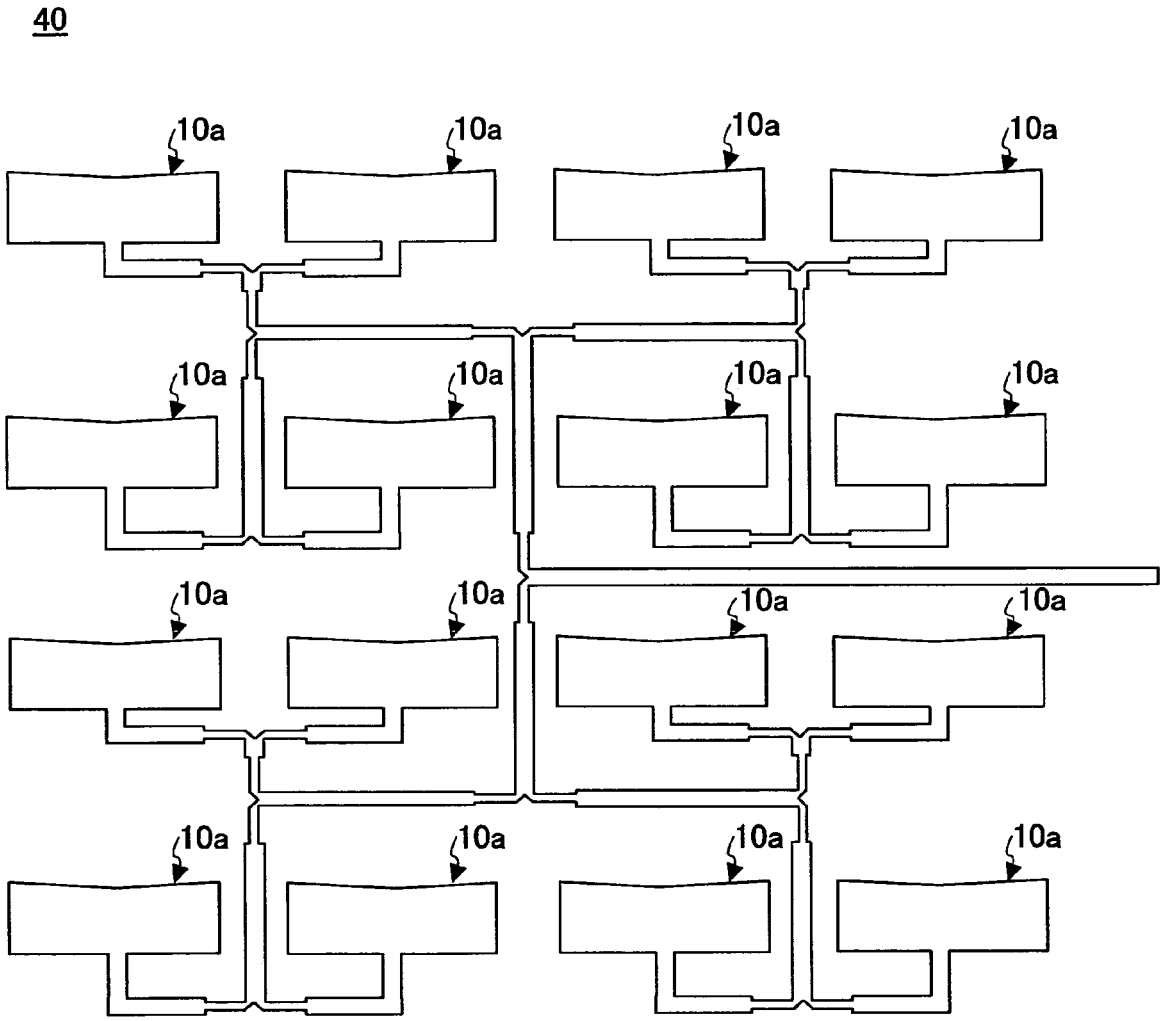
FIG. 8B is a diagram showing an array patch antenna configured by arranging 16 patch antennas according to the second embodiment of the present invention.

In the above-described embodiments, a description is given of a single patch antenna. On the other hand, multiple patch antennas may be arranged so as to form an array patch antenna as shown in FIGS. 8A and 8B. That is, multiple patch antennas, each of which may be the above-described patch antenna 10 or 10*a*, may be combined so as to form an array patch antenna.

FIG. 8A is a diagram showing an array patch antenna 30 configured by arranging four patch antennas 10*a*. FIG. 8B is a diagram showing an array patch antenna 40 configured by arranging 16 patch antennas 10*a*. The number of patch antennas 10*a* may be, but is not limited to, eight or 16. In FIGS. 8A and 8B, the patch antennas 10*a* may be replaced by patch antennas 10 of the first embodiment.

In these cases, it is necessary to align the directions of the cut parts 7 formed in the radiation elements 1 of the patch antennas 10*a*. This makes it possible to increase the antenna gain without increasing the antenna area.

Further, a mounting board having an antenna may be formed by forming the above-described patch antenna 10 or 10*a* on a mounting board for mounting an electronic component. Further, a mounting board having an antenna may also be formed by forming the above-described array patch antenna 30 or 40 on a mounting board for mounting an electronic component.

A description is given below, with reference to FIGS. 9 through 12, of a mounting board according to the second embodiment.

Figure 9:
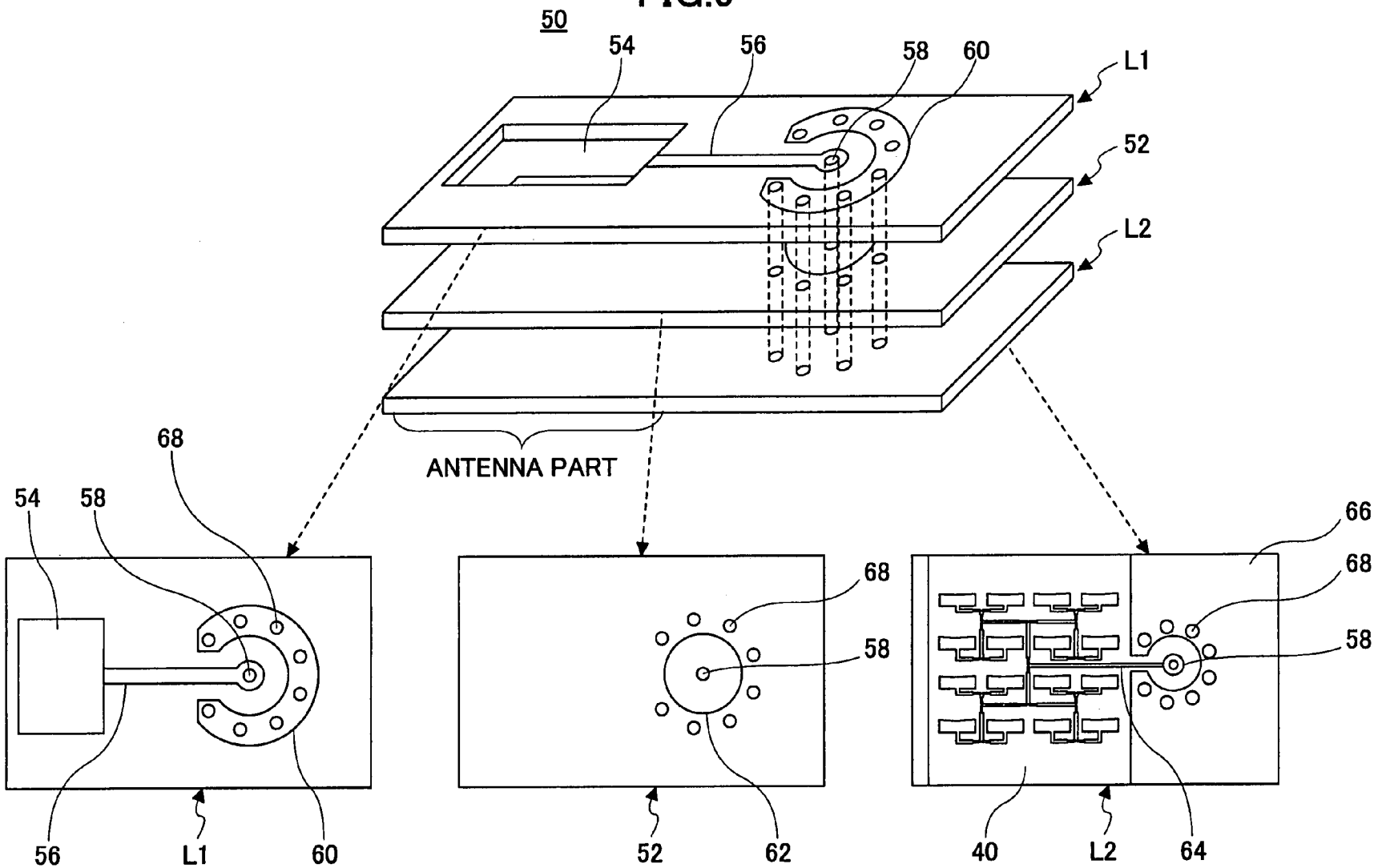
FIG. 9 is an exploded perspective view of a mounting board according to the second embodiment of the present invention.
Figure 10:
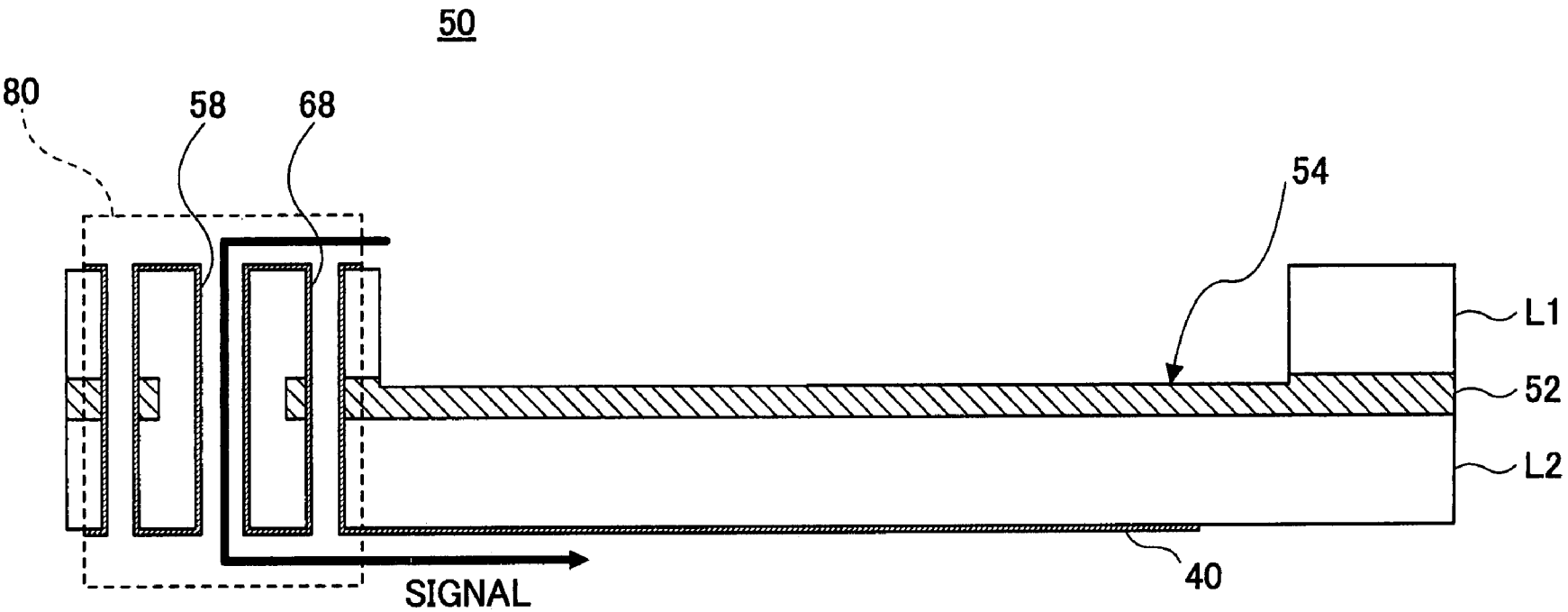
FIG. 10 is a side view of the mounting board 50 according to the second embodiment of the present invention.
Figure 11A:
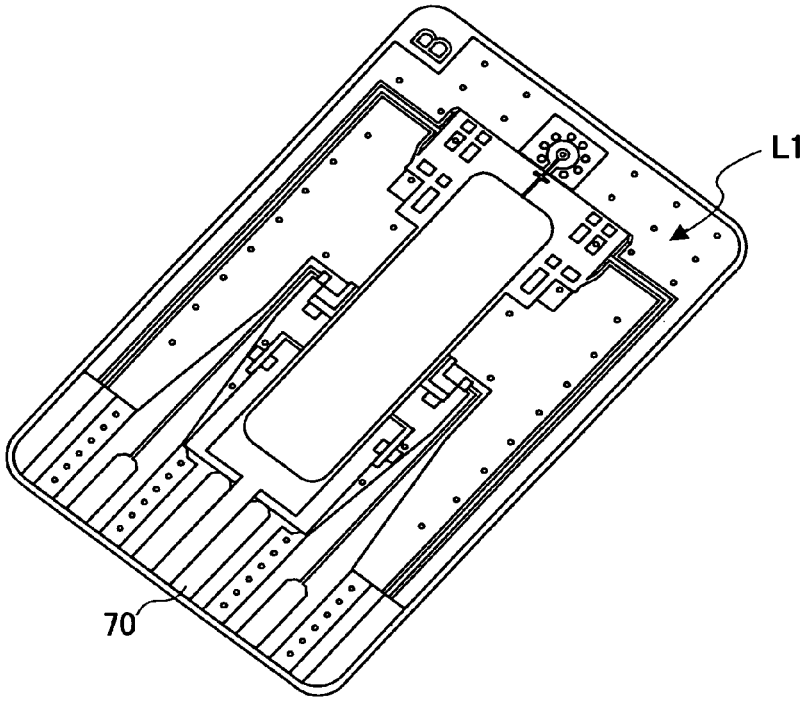
FIG. 11A is a top plan view of the mounting board according to the second embodiment of the present invention.
Figure 11B:
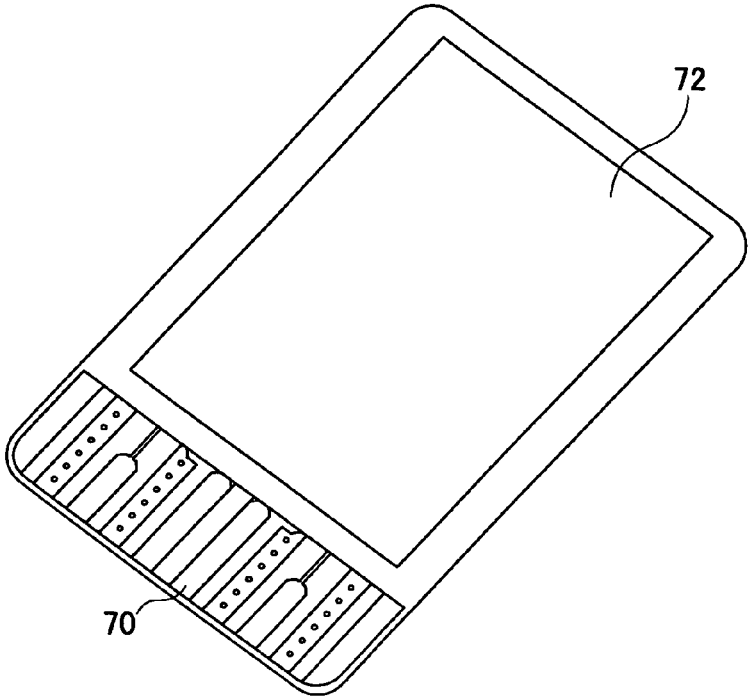
FIG. 11B is a top plan view of the mounting board on which an electronic component is mounted according to the second embodiment of the present invention.
Figure 12:
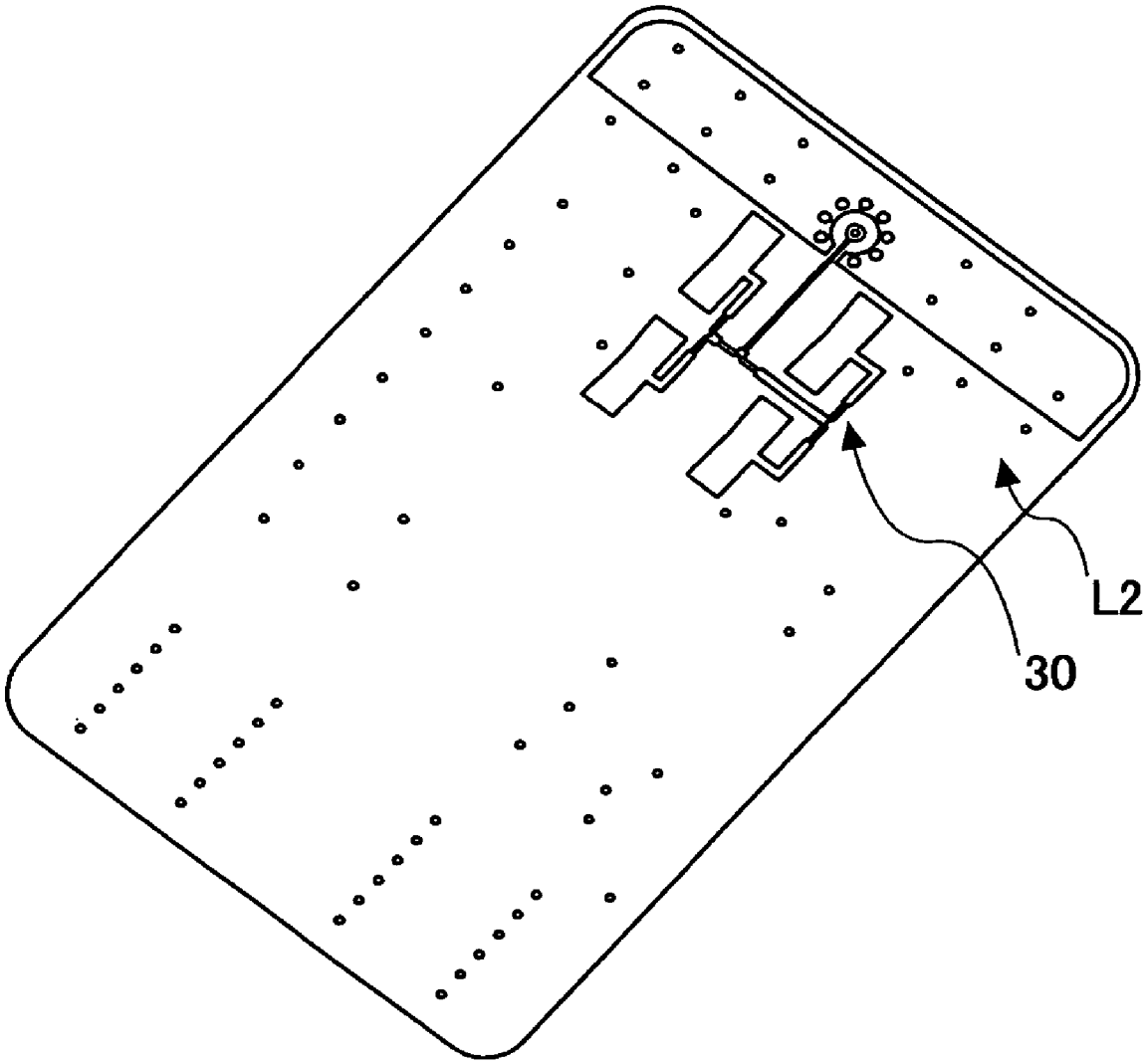
FIG. 12 is a bottom plan view of a variation of the mounting board according to the second embodiment of the present invention.

FIG. 9 is an exploded perspective view of a mounting board 50 according to the second embodiment. FIG. 10 is a side view of the mounting board 50. FIG. 11A is a top plan view of the mounting board 50. FIG. 11B is a top plan view of the mounting board 50 on which an electronic component is mounted. FIG. 12 is a bottom plan view of a variation of the mounting board 50.

Referring to FIG. 9, the mounting board 50 includes a first dielectric layer L1, a ground plane (Cu core) 52, and a second dielectric layer L2 that are stacked in layers.

A hole 54 is formed in the first dielectric layer L1 so that the ground plane 52 is exposed through the hole 54. An electronic component such as an RF device (not graphically represented in FIGS. 9 and 10) is mounted in this hole 54. Thus, the hole 54 serves as a device mounting part.

A transmission line 56 electrically connected to the RF device mounted in the hole 54 is formed on the first dielectric layer L1. The transmission line 56 is connected to a through via 58 passing through the first dielectric layer L1, the ground plane 52, and the second dielectric layer L2. A ground pattern 60 is formed around the opening of the through via 58.

An opening part 62 through which the through via 58 passes is formed in the ground plane 52. In the opening part 62, the space around the through via 58 is filled with the material of the first and second dielectric layers L1 and L2, such as resin, so as to electrically isolate the through via 58. The ground plane 52 is formed of a metal material such as a copper plate or copper foil.

A transmission line 64, a ground plane 66, and the array patch antenna 40 (FIG. 8B) formed of the multiple patch antennas 10*a* are formed on the externally exposed surface of the second dielectric layer L2, that is, the bottom surface of the mounting board 50. The array patch antenna 40 is electrically connected to the RF device through the transmission line 64, the through via 58, and the transmission line 56.

The first and second dielectric layers L1 and L2 are formed of resin such as epoxy or polyimide, or glass prepreg impregnated with such a resin.

The transmission lines 56 and 64, the array patch antenna 40 (antenna part), and the through via 58 are formed by copper plating or by patterning copper foil layers stacked on the first and second dielectric layers L1 and L2.

Multiple through vias for ground 68 are formed around the through via 58 so as to cause the through via 58 to serve as a pseudo-coaxial line. The ground through vias 68 are electrically connected to the ground plane 52, the ground plane 66 of the second dielectric layer L2, and the ground pattern 60 of the first dielectric layer L1.

The ground through vias 68, the ground plane 52, the ground plane 66 of the second dielectric layer L2, and the ground pattern 60 of the first dielectric layer L1 cause the through via 58 to serve as a pseudo-coaxial line in a coaxial conversion part 80 adjusting the impedance of the through via 58 so that the impedance of the through via 58 matches the impedance of the transmission lines 56 and 64.

Further, as shown in FIG. 11A, multiple external connection terminals (not graphically illustrated in FIGS. 9 and 10) are formed on the first dielectric layer L1. As shown in FIG. 11B, an RF device (electronic component) 72 is mounted on the mounting board 50.

In the above-described case, the array patch antenna 40 is formed on the second dielectric layer L2. Alternatively, the array patch antenna 30 may be formed on the second dielectric layer L2 as shown in FIG. 12.

In the second embodiment, a description is given of the case of providing the cut part 7 in the radiation element 1 of the patch antenna 10 described in the first embodiment. It is also possible to increase the antenna gain of the conventional patch antenna by providing the cut part 7 therein.

Further, in the above-described embodiments, a description is given of patch array antennas applicable to a 60-GHz frequency band by way of example. With respect to other frequency bands, it is also possible to configure a patch array antenna by employing the same configuration.

The present invention may be applied to a patch antenna and an array antenna used for GPS (Global Positioning System) and ETC (Electronic Toll Collection System), and a mounting board having the same.

The present invention is not limited to the specifically disclosed embodiments, and variations and modifications may be made without departing from the scope of the present invention.

The present application is based on Japanese Priority Patent Application No. 2004-322610, filed on Nov. 5, 2004, the entire contents of which are hereby incorporated by reference.

What is claimed is:

1. A patch antenna, comprising:

a dielectric substrate;

a substantially rectangular radiation element formed of a conductive material on the dielectric substrate; and a feeder line connected to a feeding point for feeding to the radiation element, wherein the feeding point has an impedance matching an impedance of the feeder line; and said radiation element including a concave part on a first side thereof opposite to a second side thereof on which the feeding point is formed, the concave part being open to an exterior side of the radiation element, wherein letting a length of the second side of the radiation element and a length of a side of the radiation element adjacent to the second side be A and B, respectively, the concave part of the radiation element is shaped substantially like a triangle having a base of A and a height greater than 0 and less than or equal to 0.2×B.

2. The patch antenna as claimed in claim , wherein the radiation element has dimensions thereof adjusted so that the impedance of the feeding point matches the impedance of the feeder line.

3. The patch antenna as claimed in claim 1, wherein a dimension of the radiation element in a direction of a side thereof on which the feeding point is formed is adjusted so that the impedance of the feeding point matches the impedance of the feeder line.

4. An array antenna, comprising:

a plurality of patch antennas combined and arranged, wherein each of the patch antennas is a patch antenna as set forth in claim 1.

5. A mounting board, comprising:

an array antenna formed by combining and arranging a plurality of patch antennas, wherein each of the patch antennas is a patch antenna as set forth in claim 1.

6. The patch antenna as claimed in claim 1, wherein the substantially rectangular radiation element is formed on one surface of the dielectric substrate.

7. A patch antenna, comprising:

a dielectric substrate; and a substantially rectangular radiation element formed of a conductive material on the dielectric substrate, wherein the radiation element includes a concave part on a first side thereof opposite to a second side thereof on which a feeding point is formed, the concave part being open to an exterior side of the radiation element, and wherein letting a length of the second side of the radiation element and a length of a side of the radiation element adjacent to the second side be A and B, respectively, the concave art of the radiation element is shaped substantially like a triangle having a base of A and a height greater than 0 and less than or equal to 0.2×B.

8. An array antenna, comprising:

a plurality of patch antennas combined and arranged, wherein each of the patch antennas is a patch antenna as set forth in claim 7.

9. A mounting board, comprising:

an array antenna formed by combining and arranging a plurality of patch antennas, wherein each of the patch antennas is a patch antenna as set forth in claim 7.

10. The patch antenna as claimed in claim 7, wherein the substantially rectangular radiation element is formed on one surface of the dielectric substrate.

* * * * *